US010530097B2

(12) United States Patent
Mühlfellner et al.

(10) Patent No.: US 10,530,097 B2
(45) **Date of Patent: *Jan. 7, 2020**

(54) PLUG CONNECTION AND SET OF PLUG CONNECTIONS

(71) Applicant: ROSENBERGER HOCHFREQUENZTECHNIK GMBH & CO. KG, Fridolfing (DE)

(72) Inventors: Helmut Mühlfellner, Kirchanschoring (DE); Ulrich Hasenöhrl, Ainring (DE); Thomas Garten, Dresden (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/400,178

(22) Filed: May 1, 2019

(65) Prior Publication Data

US 2019/0260164 A1 Aug. 22, 2019

Related U.S. Application Data

(63) Continuation of application No. 15/570,470, filed as application No. PCT/EP2016/000634 on Apr. 19, 2016, now Pat. No. 10,367,304.

(30) Foreign Application Priority Data

Apr. 30, 2015 (DE) ..... 20 2015 003 177 U

(51) Int. Cl.
*H01R 13/645* (2006.01)
*H01R 13/631* (2006.01)
(Continued)

(52) U.S. Cl.
CPC ..... *H01R 13/6456* (2013.01); *H01R 13/6315* (2013.01); *H01R 24/38* (2013.01); *H01R 2103/00* (2013.01)

(58) Field of Classification Search
CPC .. H01R 13/625; H01R 13/64; H01R 13/6456; H01R 13/6315; H01R 24/38; H01R 2103/00
(Continued)

(56) References Cited

U.S. PATENT DOCUMENTS 3,082,396 A 3/1963 Bernhard
3,136,592 A 6/1964 Miller
(Continued)

FOREIGN PATENT DOCUMENTS

DE 2646093 A1 4/1978
DE 102007025458 A1 1/2011
(Continued)

*Primary Examiner* — Gary F Paumen
(74) *Attorney, Agent, or Firm* — DeLio Peterson & Curcio LLC; Robert Curcio

(57) ABSTRACT

A plug connection having: a plug connector with, arranged thereon, a first coding element with a coding pattern and an insertion location with, arranged thereon, a second coding element with a coding pattern that matches the coding pattern, wherein the plug connector can be inserted, in an insertion direction (S), into the insertion location as far as a coupling position, when the first coding element and the second coding element adopt a predefined relative position. The first coding element can be rotated on the plug connector about an axis of rotation (A) that runs parallel to the insertion direction (S), and/or the second coding element is held on the insertion location so as to be able to rotate about the axis of rotation (A).

15 Claims, 2 Drawing Sheets

(51) Int. Cl.
*H01R 24/38* (2011.01)
*H01R 103/00* (2006.01)

(58) Field of Classification Search
USPC ..... 439/314–319, 680
See application file for complete search history.

(56) References Cited

U.S. PATENT DOCUMENTS

| | | | | |
|---|---|---|---|---|
| 4,111,514 | A | 9/1978 | Brishka et al. | |
| 4,239,325 | A | 12/1980 | Tyson | |
| 4,595,250 | A | 6/1986 | Joly et al. | |
| 5,167,522 | A | 12/1992 | Behning | |
| 5,662,488 | A | 9/1997 | Alden | |
| 8,911,263 | B2 | 12/2014 | Becavin | |
| 9,477,049 | B2 * | 10/2016 | Gniadek | G02B 6/3894 |
| 9,780,485 | B2 * | 10/2017 | Troquet | H01R 13/508 |
| 10,128,613 | B2 * | 11/2018 | Yang | H01R 13/631 |
| 2007/0202739 | A1 | 8/2007 | Blakborn et al. | |
| 2014/0357114 | A1 | 12/2014 | Pankau | |
| 2018/0159275 | A1 * | 6/2018 | Muhlfellner | H01R 13/6456 |

FOREIGN PATENT DOCUMENTS

| | | | |
|---|---|---|---|
| DE | 102007052606 | B3 | 6/2011 |
| EP | 2822106 | A1 | 1/2015 |
| GB | 2216345 | A | 4/1989 |
| JP | 2010165483 | A | 7/2010 |
| JP | 2014143160 | A | 8/2014 |
| WO | 2013091920 | A1 | 6/2013 |
| WO | 2016063377 | A1 | 4/2016 |

* cited by examiner

PLUG CONNECTION AND SET OF PLUG CONNECTIONS

BACKGROUND OF THE INVENTION

1. Field of the Invention

The present invention relates to a plug connection consisting of a plug connector and an insertion location for insertion of the plug connector. Arranged on the plug connector is a first coding element with a coding pattern, and a second coding element with a coding pattern complementary to said coding pattern is arranged on the insertion location, such that the plug connector can be inserted, in an insertion direction, into the insertion location as far as a coupling position, if the first coding element and the second coding element assume a predefined position relative to one another.

2. Description of Related Art

Coded plug connections are known from the prior art. In such plug connections, a coding mechanism ensures that the plug connector can only be inserted in a correct insertion location assigned to it. In this way, if several insertion locations are present this prevents a plug connector from being incorrectly plugged into an insertion location which is not assigned to it, which would result in a defective transmission of current or signals.

Coded plug connections are in particular known from the field of signal transmission, in order to ensure that individual cables of a bundle of signal transmission cables are coupled correctly to associated plug sockets. However, coded plug connections are also used in connectors for current transmission in order to prevent connection errors during their installation.

An insertion location is understood to mean any plug connector receptacle designed to be coupled with the plug connector, so that electrical currents can be passed from the plug connector via the insertion location. Examples of insertion locations include a fixed plug socket, a plug socket arrangement comprising several plug sockets, a mating plug arrangement, a mating plug connector which can be arranged on a cable end or similar.

In known coding mechanisms, the plug connector has a first coding element with a coding pattern, and the insertion location has a second coding element with a complementary coding pattern which matches the coding pattern. The plugging pattern can be designed in the form of a predefined spatial arrangement of projections and/or depressions on the plug connector which are designed to engage with a complementary spatial arrangement of depressions and/or projections on the insertion location.

Accordingly, the plug connector with the coding pattern can be coupled, in the insertion direction, with the mating plug connector with the complementary coding pattern if the plug connector and the insertion location are arranged relative to one another such that on insertion the coding pattern engages in the complementary coding pattern in the right position.

In the coupling position, contact elements of the plug connector and insertion location are in electrical contact, and the plug connector is located in an axial end position on the insertion location.

In conventional coded plug connections, in some cases several plugging attempts in different relative positions of plug connector and insertion location need to be made by the installer before the first coding element engages in the second coding element in the right position and the plugging operation can be carried out successfully. Where multiple plug connections need to be coupled, for example in order to couple a cable bundle, numerous plugging attempts are therefore often necessary. The coupling of conventional plug connections is therefore time-consuming and laborious.

SUMMARY OF THE INVENTION

In view of the problems described, it is the object of the present invention to provide a coded plug connection which nonetheless reliably prevents incorrect coupling.

This object is achieved by means of a plug connection according to the independent claims. Advantageous further developments of the invention are described in the dependent claims. Claims to a set of plug connections are also provided.

The above and other objects, which will be apparent to those skilled in the art, are achieved in the present invention which is directed to a plug connection, comprising a plug connector with a first coding element arranged thereon with a coding pattern and an insertion location with a second coding element arranged thereon with a coding pattern complementary to the coding pattern, wherein the plug connector can be inserted, in an insertion direction (S), into the insertion location as far as a coupling position, if the first coding element and the second coding element assume a predefined position relative to one another, wherein the first coding element is held on the plug connector so as to be rotatable around an axis of rotation (A) running parallel to the insertion direction (S) and/or the second coding element is held on the insertion location so as to be rotatable around the axis of rotation (A), and having a self-alignment mechanism such that when plugging in the plug connector, the first coding element and the second coding element are automatically rotated into the predefined position relative to one another.

The first coding element is a ring element surrounding a main body of the plug connector, and/or the second coding element is a sleeve part held rotatably on the insertion location so as to allow introduction of the ring element, or vice versa.

The first coding pattern is in the form of preferably several radially outwardly-projecting projections, and/or the second coding pattern is in the form of preferably several guide grooves, each configured for engagement of a projection, or vice versa. The first coding pattern and the second coding pattern may exhibit a multiple radial symmetry.

The first coding element is a ring element with preferably two, three, or more radially projecting projections, spaced apart from one another at a predefined angle in a circumferential direction, and that the second coding element is a sleeve part with two, three or more guide grooves formed in an inner wall of the sleeve part and spaced apart from one another in a circumferential direction at the predefined angle.

The second coding element has a contact surface with a directional component in a circumferential direction and a directional component in the insertion direction (S), wherein, on plugging in the plug connector, the first coding element comes into contact with the contact surface and slides along this, accompanied by a relative rotation between the first and the second coding elements.

A groove width (B) of at least one guide groove is reduced in the insertion direction (S), at least in sections.

At least one of the guide grooves has an entry section with a groove width (B) which narrows in the insertion direction (S) and a guide section following on from the entry section in the insertion direction with substantially constant groove width which is preferably matched to a projection width of at least one associated projection.

"n" guide grooves are formed in the sleeve part with n >1, such that the guide grooves, at their front end, cover a circumferential angular range of approximately 360%, the groove walls of adjacent guide grooves being directly adjacent to one another at their front end.

The insertion location has a press-in ring for pressing into a socket part and the coding element, attached rotatably to the press-in ring and projecting in a sleeve-formed manner in the direction of the plug connector.

The plug connector is a high current plug connector connected to a shielded high current cable with an inner conductor contact and an outer conductor surrounding the inner conductor contact, at least in sections, on the outer boundary surface of which the first coding element is arranged.

In a second aspect, the present invention is directed to a plug connector of a plug connection, wherein the plug connection comprises the plug connector having a first coding element arranged thereon with a coding pattern and an insertion location with a second coding element arranged thereon with a coding pattern complementary to the coding pattern, wherein the plug connector can be inserted, in an insertion direction (S), into the insertion location as far as a coupling position, if the first coding element and the second coding element assume a predefined position relative to one another, wherein the first coding element is held on the plug connector so as to be rotatable around an axis of rotation (A) running parallel to the insertion direction (S) and/or the second coding element is held on the insertion location so as to be rotatable around the axis of rotation (A), and having a self-alignment mechanism such that when plugging in the plug connector, the first coding element and the second coding element are automatically rotated into the predefined position relative to one another.

In a third aspect, the present invention is directed to an insertion location of a plug connection wherein, the plug connection is as described above.

In a fourth aspect, the present invention is directed to a set of plug connections having a first plug connection and a second plug connection, each plug connection as described above, wherein the coding pattern and the complementary coding pattern of the first and the second plug connection in each case differ from one another such that the plug connector of the first plug connection can be plugged, as far as the coupling position, into the insertion location of the first plug connection, but not into the insertion location of the second plug connection.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
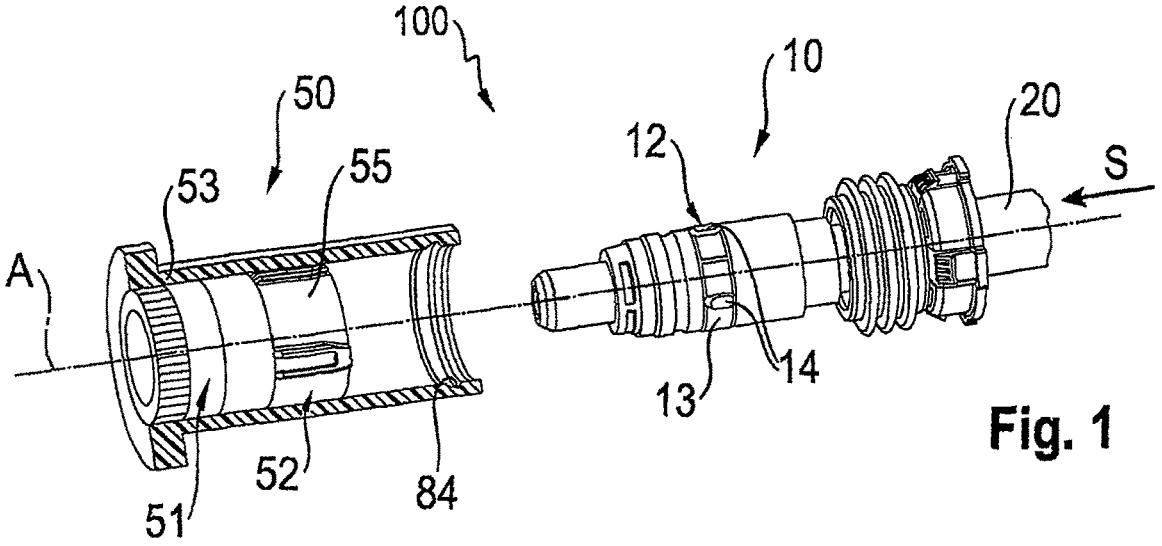
FIG. 1 shows a side view of an embodiment of a plug connection according to the invention, partially in the form of a sectional view, prior to coupling.

In describing the preferred embodiment of the present invention, reference will be made herein to FIGS. 1-4 of the drawings in which like numerals refer to like features of the invention.

In a plug connection according to the invention, the first coding element is held on the plug connector so as to be rotatable around an axis of rotation running parallel to the insertion direction and/or the second coding element is held on the insertion location so as to be rotatable around the axis of rotation. In other words, in a first embodiment of the invention only the first coding element is held on the plug connector so as to be rotatable around an axis of rotation running parallel to the insertion direction, in a second embodiment of the invention only the second coding element is held on the insertion location so as to be rotatable around the axis of rotation running parallel to the insertion direction, and in a third and particularly preferred embodiment of the invention the first and the second coding element are held rotatably on the plug connector/on the insertion location.

The invention is based on the knowledge that in conventional plug connections the cable installer often has to try out several relative rotational positions between plug connector and insertion location before the coding pattern engages in the complementary coding pattern in the right position, making possible the plugging operation. However, rotations of the entire insertion location and rotations of the plug connector, to which a torsionally stiff cable is generally attached, are laborious and can lead to damage to the plug connector. In contrast, in the plug connection according to the invention it is sufficient simply to rotate the first and/or the second coding element such that it is oriented in the right position relative to the other coding element, whereupon a plugging operation is possible. In contrast, a rotation of the main body of the plug connector with cable attached thereto or a rotation of the entire insertion location is not necessary according to the invention.

The rotatable first coding element and/or the rotatable second coding element are preferably held on the plug connector or on the insertion location such that the coding pattern is readily recognizable by the cable installer and/or is accessible to the cable installer for the purpose of rotation. This facilitates, on the one hand, the adjustment of the predefined relative position between the plug connector and the insertion location prior to insertion, and on the other hand facilitates the correct selection of a plug connector associated with an insertion location where several plug connections are provided. In particular, the first coding element forms an outer boundary surface of the plug connector, can be viewed without any problem prior to insertion and/or is preferably exposed in a radially outward direction.

In order to achieve a further simplification of the coupling operation between the plug connector and the insertion location it has proved expedient if the plug connection according to the invention has a self-alignment mechanism by means of which, when plugging in the plug connector, the first coding element and the second coding element are automatically rotated into the predefined position relative to one another. This self-alignment between the two coding elements can be effected by means of a relative force acting between the two coding elements during insertion in the insertion direction. In other words, the self-alignment mechanism comprises a force-deflection mechanism converting a plugging force directed in an insertion direction into a rotational force aligning the coding elements in the circumferential direction. Due to the coding, a plug connection according to the invention with self-alignment mechanism prevents the coupling of pairs of plug connectors and insertion locations which do not belong together and at the same time eliminates unsuccessful plugging attempts, since the correct orientation of the coding elements takes place automatically.

Preferably, the contour of the plug connector and/or of the insertion location in a sectional plane oriented perpendicular to the insertion direction is substantially round, preferably substantially rotationally symmetrical, and in particular roughly circular. Conventional coded plug connections with a round contour present particular plugging problems due to the large number of apparently plausible relative rotational positions between plug connector and insertion location which can be eliminated by means of the self-alignment mechanism according to the invention.

In a preferred embodiment of the invention, the first coding element is a ring element surrounding a main body of the plug connector and held rotatably on the main body. Alternatively or additionally, the second coding element is a sleeve part held rotatably on the insertion location so as to allow introduction of the ring element. An outer diameter of the ring element is thereby preferably matched to an inner diameter of the sleeve part, so that the ring element can be introduced into the sleeve part with the coding pattern of the ring element engaging radially in the complementary coding pattern of the sleeve part.

Conversely, in an alternative embodiment of the invention the first coding element is a sleeve part held rotatably on a main body of the plug connector, and the second coding element is a ring element held rotatably on the insertion location which matches the sleeve part.

The ring element is not necessarily a ring which is closed in a circumferential direction; it can also be in the form of a partial ring or can be split, so that it can be fitted or clipped onto the plug connector from the side. Preferably, the ring element is held in a circumferential groove of the main body of the plug connector in such a way that it is fixed in the groove in the insertion direction but can be rotated within the groove in a circumferential direction around the main body. In order to achieve a good fixing of the ring element while at the same time providing a reliable coding mechanism, the depth of the groove can be matched to a radial ring thickness of the ring element, wherein the coding pattern provided on the ring element projects radially from the groove.

In order to achieve good sliding properties of the ring element relative to the main body it is expedient if the ring element is made of a plastic material, wherein the groove can be formed in a main body made of a metal such as aluminum. In particular, the groove can be formed in a metallic outer conductor part of the plug connector.

Alternatively or additionally, the sleeve part is made of a plastic material and/or is attached rotatably to a socket part of the insertion location which is made of metal. A swivel bearing can be provided between the socket part and the sleeve part which can for example be formed by an annular projection engaging radially in an annular groove.

In preferred embodiments, the ring element is provided with the coding pattern, which is preferably in the form of a predefined spatial arrangement of projections and/or grooves, and the sleeve part is provided with the complementary coding pattern, which is preferably in the form of a negative form of said coding pattern and exhibits a complementary spatial arrangement of projections and/or grooves. When the ring element and the sleeve part assume a predefined rotational position (or one of several possible predefined rotational positions) relative to one another, during the plugging operation the coding pattern of the ring element engages radially in the complementary coding pattern of the sleeve part.

For this purpose it is advantageous if the first coding pattern is designed in the form of preferably several radially outwardly-projecting projections, and/or the second coding pattern is designed in the form of preferably several guide grooves, each intended for the introduction of a projection, or vice versa.

The projections preferably project outwards in a radial direction from a ring section of the ring element. The guide grooves preferably run, at least in sections, in the insertion direction, within the inner wall of the sleeve part, wherein the distances between adjacent projections of the ring element are matched to the distances between adjacent guide grooves of the sleeve part.

A simply manufactured and reliable coding mechanism can be provided in that the first coding pattern and the second coding pattern possess a multiple radial symmetry such as a 2-fold, 3-fold or 4-fold radial symmetry. In other words, the ring element has two preferably identically formed projections arranged at an angle of 180°, three projections each arranged at an intervening angle of 120°, four projections each arranged at an intervening angle of 90° or similar. The same applies to the guide grooves formed in the sleeve part. A coding mechanism with n-fold radial symmetry offers the advantage of n predefined relative positions in each of which a plugging operation is possible. In this case only a comparatively small relative rotation between the first and the second coding element, i.e., at most a relative rotation by 360°/2n, is necessary in order, starting out from any given initial rotational position, to arrive at a predefined relative position which allows coupling, as a result of which the coupling operation can be further simplified.

In a particularly preferred embodiment of the invention, the first coding element is a ring element with two, three or more radially projecting projections, spaced apart from one another at a predefined angle in a circumferential direction. The second coding element is a sleeve part with two, three or more guide grooves formed in an inner wall of the sleeve part and spaced apart from one another in a circumferential direction at said predefined angle.

A reliably functioning self-alignment mechanism can be provided in that the width of at least one guide groove is reduced in the insertion direction, at least in sections. In this case, the projection engaging in a wide entry section of the guide groove on insertion is, during the further course of the plugging operation, guided by the narrowing groove walls into a narrow groove section, while the coding elements are aligned correctly in relation to one another, so that the plug connector can be introduced in the insertion location as far as its coupling position.

The self-alignment mechanism can be further improved in that the at least one guide groove—and preferably all the guide grooves—have an entry section with a groove width which narrows in the insertion direction and a guide section following on from the entry section in the insertion direction with substantially constant groove width. In the guide section, the groove width is preferably substantially matched to a width of an associated projection, so that the two coding elements are substantially connected with one another non-rotatably when the projection is arranged in the guide section—the coding pattern and the complementary coding pattern engage in one another.

Preferably, the width of the projections in a circumferential direction is between 0.5 mm and 10 mm, in particular between 1 mm and 3 mm. Also, the width of the guide sections of the guide grooves in a circumferential direction is preferably between 1 mm and 11 mm, in particular between 1.5 mm and 4 mm, so that the projections fit into the guide sections with a slight degree of play.

The axial length of the entry sections of the guide grooves preferably amounts to more than 1 mm and less than 20 mm, particularly preferably between 3 mm and 10 mm. The axial length of the guide sections the guide grooves with substantially constant groove width preferably amounts to more than 10 mm and less than 50 mm, particularly preferably between 20 mm and 30 mm.

A malfunction of the self-alignment mechanism can be prevented in that n (n>1) guide grooves are formed in the sleeve part, wherein the guide grooves on the front wide end of the narrowing entry section cover a circumferential angular range of around 360%, such that the groove walls of adjacent guide grooves are directly adjacent to one another or merge into one another on the front end. In this case it is ensured that, during insertion, irrespective of their initial rotational position the projections encounter a narrowing groove wall, which leads to a relative rotation between the coding elements, with the projections sliding along the groove walls. In particular, the guide grooves narrow on both sides in the entry section in a symmetrical manner in the direction of the respective guide section of the guide groove.

Preferably, the second coding element has one or more contact surfaces, in each case with a directional component in a circumferential direction and a directional component in the insertion direction, wherein, on plugging in the plug connector, the first coding element comes into contact with the contact surface and slides along this, accompanied by a relative rotation between the first and the second coding elements. In particular, each contact surface extends over a fraction of a full revolution, substantially in the manner of a helix.

In a particularly preferred embodiment, these contact surfaces are formed by the side walls of the guide grooves in their entry section.

According to a particularly preferred embodiment, the insertion location is designed in the form of a plug socket. The insertion location can thereby have a press-in ring for pressing into a socket part and the second coding element attached rotatably to the press-in ring and projecting in a sleeve-formed manner in the direction of the plug connector. The press-in ring can be pressed into the also sleeve-formed socket part through the application of pressure and for this purpose is preferably provided with a knurled surface improving frictional locking when it is pressed in. After being pressed in, the press-in ring is held in a fixed position on the socket part while the coding element is held rotatably relative to the arrangement consisting of press-in ring and socket part. Preferably, the socket part has an axial dimension which allows the second coding element to be accommodated completely within the interior of the socket part.

The plug connector can be designed for the transmission of high current or alternatively for the transmission of signals. In the case of a high current plug connector, this is preferably connected to a preferably shielded high current cable. The plug connector has at least one inner conductor contact connected with, and preferably crimped to, an inner conductor of the cable and an outer conductor surrounding the inner conductor contact, at least in sections, which can be pressed together with an outer conductor of the cable. In a preferred embodiment, the first coding element is arranged on the outer boundary surface of the outer conductor.

Preferably, the plug connection is designed as an inseparable plug connection. An "inseparable" plug connection is understood to mean that while manual coupling by means of a simple plugging action is possible, subsequent uncoupling is no longer possible, or is only possible with the aid of a tool. For this purpose, the plug connection can be provided with snap-locking or latching elements which snap unreleasably into engagement before, or on reaching the coupling position. A coding mechanism is particularly important in the case of an inseparable plug connection, since incorrectly coupled plug connections can no longer readily be uncoupled.

For this purpose, the plug connector is preferably provided with one or more snap-locking projections and the insertion location is provided with a circumferential snap-locking groove for engagement of the snap-locking projections. The snap-locking projections can be provided on a snap-locking ring surrounding the plug connector, and the snap-locking groove can be formed in the inner wall of the socket part of the insertion location.

According to a further aspect, the invention relates to a plug connector of a plug connection according to the invention which is designed to be plugged into an insertion location. The plug connector according to the invention has a first coding element with a coding pattern arranged thereon, wherein the coding element is held on the plug connector so as to be rotatable around an axis of rotation running parallel to an insertion direction. The plug connector according to the invention can also exhibit any of the features described herein, either individually or in any combination, without these being repeated.

According to a further aspect, the present invention relates to an insertion location of a plug connection according to the invention which is designed for insertion of a plug connector. The insertion location according to the invention has second coding element arranged thereon with a coding pattern which is complementary to the coding pattern of an associated plug connector, wherein the second coding element is held on the insertion location so as to be rotatable around an axis of rotation running parallel to an insertion direction. The insertion location according to the invention can also exhibit any of the features described herein, either individually or in any combination, without these being repeated.

According to a further aspect, the present invention relates to a set of plug connections according to the invention. A "set" is understood to mean two, three, four or more plug connections according to the invention. The coding pattern and the complementary coding pattern of a first and a second plug connection of the set in each case differ from one another such that the plug connector of the first plug connection can be plugged, as far as the coupling position, into the insertion location of the first plug connection, but not into the insertion location of the second plug connection.

Preferably, the plug connection comprises three or more plug connections according to the invention, the plug connectors of which can in each case only be plugged into exactly one associated insertion location as far as the coupling position.

A set according to the invention set thus comprises several pairs of plug connectors and associated insertion locations which, because of the coding mechanism provided, can in each case only be coupled in the correct manner. An incorrect coupling of a plug connector of a first plug connection with an insertion location of a second plug connection can be prevented by means of the coding pattern. At the same time a simple coupling is possible, since the coding elements with the coding pattern are rotatable, so that the entire plug connector or the entire insertion location does not need to rotate in order to arrange them in the predefined relative position. If the individual plug connections are in each case in addition provided with a self-alignment mechanism, a particularly simple coupling is possible, since on plugging the plug connector of a plug connection into the insertion location of this plug connection the first coding element and the second coding element are automatically rotated into the predefined position relative to one another. Furthermore, it is immediately apparent to the installer, on the first plugging attempt, that a plug connector and an insertion location do not belong to the same plug connection if no self-alignment takes place and an insertion as far as the coupling position is therefore not possible.

A set of plug connections according to the invention consists for example of three plug connectors for the transmission of the U, V and W phases of a three-phase alternating current, for example of an electric motor, and three insertion locations assigned to this plug connector. In this case, a correct coupling is particularly important.

In the following description, the invention is explained with reference to the enclosed drawings.

A plug connection 100 according to the invention consisting of a plug connector 10 and an insertion location 50 is illustrated in FIG. 1.

Figure 2:
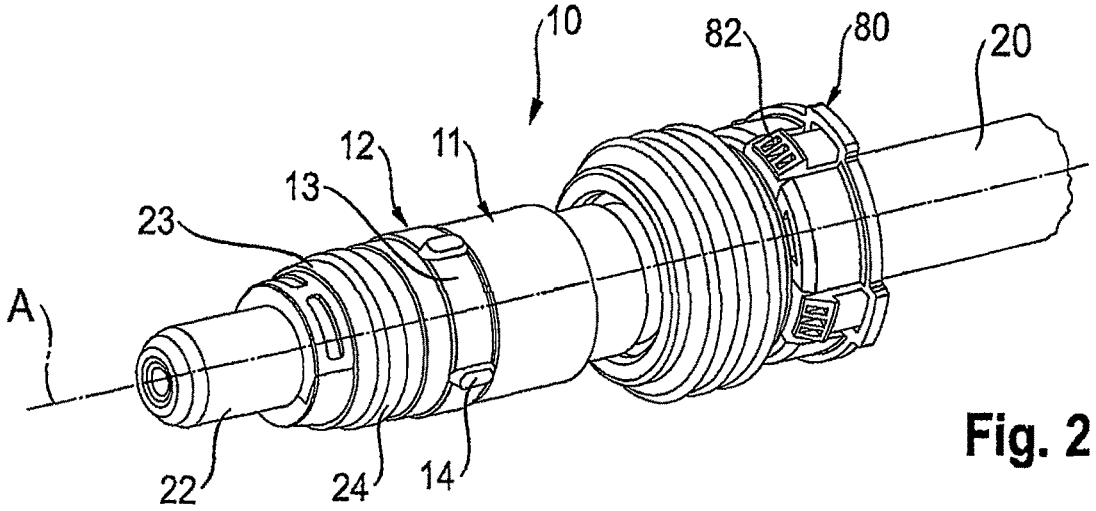
FIG. 2 shows a perspective view of the plug connector of the plug connection shown in FIG. 1.

The plug connector is illustrated particularly clearly in FIG. 2: The plug connector 10 is a high current plug connector with an inner conductor contact 22 for the transmission of high current, for example 50 A, 100 A or more. The plug connector 10 is attached to a cable end of a shielded high current cable 20. The shielding of the high current cable 20, usually a wire braid, makes electrical contact with an outer conductor 24 of the plug connector 10. An insulating component 23 is arranged between the inner conductor contact 22 and the outer conductor 24 of the plug connector.

In other embodiments, the plug connector does not have an outer conductor contact and/or is configured for the transmission of signals. The plug connector can also have more than one inner conductor contact, for example one or more differential contact pairs.

The plug connector 10 has a first coding element 12 in the form of a ring element 13 which surrounds a main body 11 of the plug connector. For this purpose, the ring element is arranged in a circumferential groove which is formed in the main body 11 of the plug connector—in this case in the outer conductor 24 of the plug connector. The ring element 13 is a split plastic ring, so that on the one hand it can be fitted onto the main body 11 from the side, and on the other hand slides readily within the groove.

The ring element 13 is arranged on the plug connector 10 so as to be rotatable around an axis of rotation "A" running centrally through the plug connector 10 in an axial direction.

The ring element 13 has several radially outwardly-projecting projections 14 by means of which a coding pattern is formed. The projections project from the groove, so that on insertion into the insertion location 50 they can be brought into engagement with a complementary coding pattern formed by guide grooves.

In the example shown, the ring element 13 has a total of four projections 14 which each project at an angle of 90° to the adjacent projection 14. The coding pattern thus exhibits a 4-fold radial symmetry. In other embodiments, two, three, or more than four projections are provided on the ring element which can project from the ring element in a radially symmetrical manner. In other embodiments with other coding patterns, the projections do not project from the ring element in a radially symmetrical manner; not all the angles between adjacent projections are equal. Nor are the projections necessarily equally wide in the circumferential direction. For the person skilled in the art it is readily understood that numerous different coding patterns can be provided on the ring element 13 in this manner.

Figure 3:
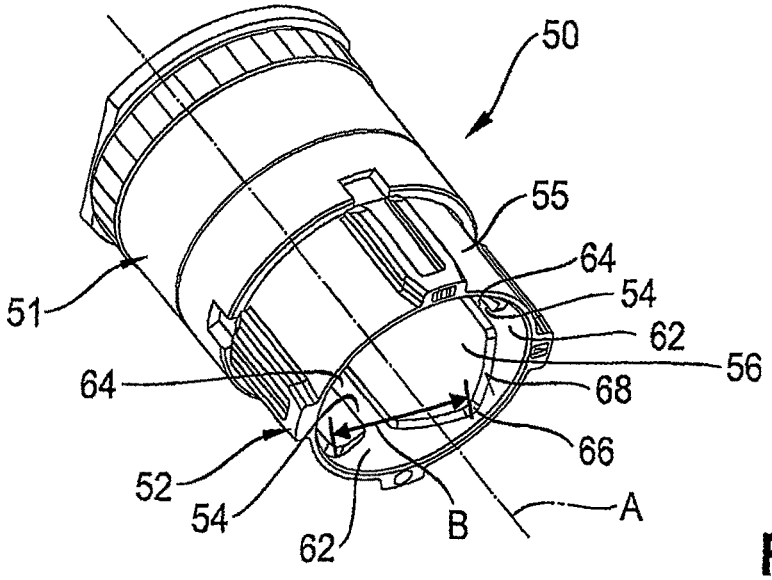
FIG. 3 shows a perspective view of the insertion location of the plug connection shown in FIG. 1.

The insertion location 50 is illustrated particularly clearly in FIG. 3: The insertion location is substantially socket-formed or hollow-cylinder-formed and configured for insertion of the plug connector 10 in the insertion direction "S" as far as a coupling position. In the coupling position, the inner conductor contact 22 of the plug connector 10 is in electrical contact with a mating contact (not shown) of the insertion location 50.

The illustrated insertion location 50 has a press-in ring 51 which is pressed into a socket part 53 (see FIG. 1). In order to increase the frictional locking of this pressed connection, sections of the press-in ring or the socket part can be knurled in sections. A sleeve part 55 is held on the press-in ring 51 in such a way that the sleeve part 55 can be rotated relative to the press-in ring 51 and the socket part 53 around the axis of rotation A. The sleeve part 55 consists of plastic, while the press-in ring and the socket part are made of metal, for example aluminum.

The sleeve part 55 forms a second coding element 52 with a coding pattern complementary to the coding pattern which is arranged rotatably on the insertion location 50. For this purpose a rotating mechanism is provided between the press-in ring 51 and the sleeve part 55.

FIG. 3 shows, in a perspective view, the arrangement consisting of the press-in ring 51 and sleeve part 55 without the socket part 53.

In other embodiments, the insertion location 50 can have a structure which differs from the structure shown in the figures. However, the important feature is the coding element 52 with the coding pattern complementary to the coding pattern of the plug connector which makes possible an engagement of the two coding elements on plugging in the plug connector 10, and which prevents the insertion of a plug connector with a non-matching coding pattern.

In the embodiment shown, the second coding element 52 is held rotatably on the insertion location 50 and the first coding element 12 is also held rotatably on the plug connector 10. In other embodiments, either only the first coding element or only the second coding element is rotatable.

The complementary coding pattern formed in the second coding element 52 is illustrated particularly clearly in FIG. 3. The inner wall 56 of the sleeve part has several guide grooves 54 running in the insertion direction S, which are in each case configured for engagement of a projection 14 of the plug connector 10.

The number of, and distance between the guide grooves 54 corresponds to the number of and the distance between the projections 14, so that each projection 14 can engage radially in a guide groove 54 on insertion of the plug connector 10 into the sleeve part 55.

Each guide groove 54 has two sections: an entry section 62 facing the plug connector 10 on insertion in which the width B of the groove gradually narrows, and a guide section 64 following on from the entry section 62 in the insertion direction S in which the width of the guide groove is substantially constant and matched to the width of the associated projection 14.

Where a total of four or n guide grooves 54 are provided, the width B of each guide groove 54 at the front end of the entry section 62 corresponds to an angular range in the circumferential direction of 90° or an angular range of 360°/n, so that irrespective of the initial relative rotational position between the first coding element 12 and the second coding element 52 it is ensured that the projections 14 in each case enter one of the guide grooves 54. In other words, all the guide grooves on the front end of the sleeve part cover an angular range of 360° and then narrow, preferably symmetrically on both sides, in the direction of the respective guide section 64.

This configuration of the guide grooves 54 provides a self-alignment mechanism which ensures that when the plug connector is plugged into the insertion location the first coding element and the second coding element are automatically rotated into the predefined position relative to one another.

This is because when the plug connector 10 is plugged in, the projections 14 come into contact with the narrowing groove walls which form the contact surfaces 68, so that the insertion force directed in the insertion direction S is transformed into a rotational force between the two coding elements 12, 52.

In FIG. 2 shows a plug connector 10 according to the invention in a perspective view.

The plug connector 10 is configured for inseparable connection with the insertion location 50 and for this purpose has a ring-formed claw element 80 with snap-locking projections 82 designed to engage in a snap-locking recess 84 of the insertion location. The plug connection 10 can then only be released from the coupling position by means of a tool.

Figure 4:
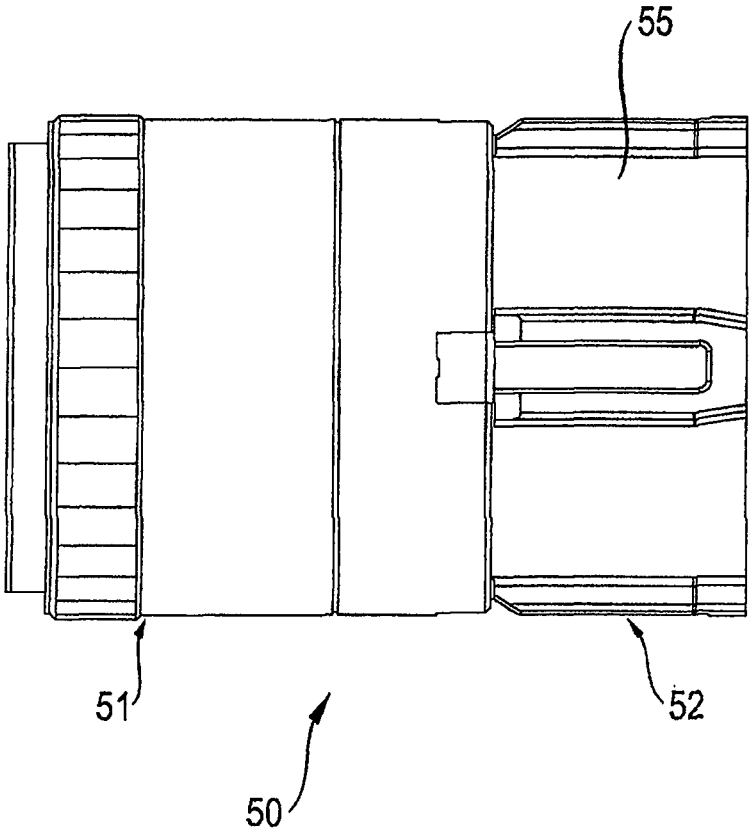
FIG. 4 shows a side view of the insertion location shown in FIG. 3.

FIGS. 3 and 4 show an insertion location 50 according to the invention in a perspective view, as well as in a side view.

The invention also comprises a set of plug connections according to the invention, in each case with different coding patterns and complementary coding patterns, so that each plug connector can only be plugged into the insertion location assigned to it, so that no incorrect plugged connections can take place.

The invention is not limited to the embodiments illustrated in the drawings. The features set forth in the description and in the claims can also be combined with one another in a different manner.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connection, comprising a plug connector with a first coding element arranged thereon with a coding pattern and an insertion location with a second coding element arranged thereon with a coding pattern complementary to said coding pattern, wherein the plug connector can be inserted, in an insertion direction (S), into the insertion location as far as a coupling position, if the first coding element and the second coding element assume a predefined position relative to one another, wherein the first coding element is held on the plug connector so as to be rotatable around an axis of rotation (A) running parallel to the insertion direction (S) and the second coding element is held on the insertion location so as to be rotatable around the axis of rotation (A), and having a self-alignment mechanism such that, when plugging in the plug connector, the first coding element and the second coding element are automatically rotated into the predefined position relative to one another.

2. The plug connection of claim 1, wherein the first coding element is a ring element surrounding a main body of the plug connector, and/or the second coding element is a sleeve part held rotatably on the insertion location so as to allow introduction of the ring element, or vice versa.

3. The plug connection of claim 1, wherein the first coding pattern is in the form of preferably several radially outwardly-projecting projections, and/or the second coding pattern is in the form of preferably several guide grooves, each configured for engagement of a projection, or vice versa.

4. The plug connection of claim 3, wherein the first coding pattern and the second coding pattern exhibit a multiple radial symmetry.

5. The plug connection of claim 1, wherein the first coding element is a ring element with two, three or more radially projecting projections, spaced apart from one another at a predefined angle in a circumferential direction, and that the second coding element is a sleeve part with two, three or more guide grooves formed in an inner wall of the sleeve part and spaced apart from one another in a circumferential direction at said predefined angle.

6. The plug connection of claim 5, wherein a groove width (B) of at least one guide groove is reduced in the insertion direction (S), at least in sections.

7. The plug connection of claim 6, wherein the at least one of the guide grooves has an entry section with a groove width (B) which narrows in the insertion direction (S) and a guide section following on from the entry section in the insertion direction with substantially constant groove width which is preferably matched to a projection width of at least one associated projection.

8. The plug connection of claim 1, wherein the second coding element has a contact surface with a directional component in a circumferential direction and a directional component in the insertion direction (S), wherein, on plugging in the plug connector, the first coding element comes into contact with the contact surface and slides along this, accompanied by a relative rotation between the first and the second coding elements.

9. The plug connection of claim 1, wherein the insertion location has a press-in ring for pressing into a socket part and the coding element, attached rotatably to the press-in ring and projecting in a sleeve-formed manner in the direction of the plug connector.

10. The plug connection of claim 1, wherein the plug connector is a high current plug connector connected to a shielded high current cable with an inner conductor contact and an outer conductor surrounding the inner conductor contact, at least in sections, on the outer boundary surface of which the first coding element is arranged.

11. The plug connection of claim 4, wherein the multiple radial symmetry is 2-fold, 3-fold, or 4-fold.

12. The plug connection of claim 6, wherein all of the guide grooves has an entry section with a groove width (B) which narrows in the insertion direction (S) and a guide section following on from the entry section in the insertion direction with substantially constant groove width which is preferably matched to a projection width of at least one associated projection.

13. A plug connector of a plug connection, wherein the plug connection comprises the plug connector having a first coding element arranged thereon with a coding pattern and an insertion location with a second coding element arranged thereon with a coding pattern complementary to said coding pattern, wherein the plug connector can be inserted, in an insertion direction (S), into the insertion location as far as a coupling position, if the first coding element and the second coding element assume a predefined position relative to one another, wherein the first coding element is held on the plug connector so as to be rotatable around an axis of rotation (A) running parallel to the insertion direction (S) and the second coding element is held on the insertion location so as to be rotatable around the axis of rotation (A), and having a self-alignment mechanism such that when plugging in the plug connector, the first coding element and the second coding element are automatically rotated into the predefined position relative to one another.

14. An insertion location of a plug connection wherein, the plug connection comprises a plug connector having a first coding element arranged thereon with a coding pattern and the insertion location having a second coding element arranged thereon with a coding pattern complementary to said coding pattern, wherein the plug connector can be inserted, in an insertion direction (S), into the insertion location as far as a coupling position, if the first coding element and the second coding element assume a predefined position relative to one another, wherein the first coding element is held on the plug connector so as to be rotatable around an axis of rotation (A) running parallel to the insertion direction (S) and the second coding element is held on the insertion location so as to be rotatable around the axis of rotation (A), and having a self-alignment mechanism such that when plugging in the plug connector, the first coding element and the second coding element are automatically rotated into the predefined position relative to one another.

15. A plug connection, comprising a plug connector with a first coding element arranged thereon with a coding pattern and an insertion location with a second coding element arranged thereon with a coding pattern complementary to said coding pattern, wherein the plug connector can be inserted, in an insertion direction (S), into the insertion location as far as a coupling position, if the first coding element and the second coding element assume a predefined position relative to one another, wherein the first coding element is held on the plug connector so as to be rotatable around an axis of rotation (A) running parallel to the insertion direction (S) and/or the second coding element is held on the insertion location so as to be rotatable around the axis of rotation (A), and having a self-alignment mechanism such that, when plugging in the plug connector, the first coding element and the second coding element are automatically rotated into the predefined position relative to one another, wherein the second coding element is a sleeve part with two, three or more guide grooves formed in an inner wall of the sleeve part and spaced apart from one another in a circumferential direction at said predefined angle, wherein a groove width (B) of at least one guide groove is reduced in the insertion direction (S), at least in sections, wherein the at least one of the guide grooves has an entry section with a groove width (B) which narrows in the insertion direction (S) and a guide section following on from the entry section in the insertion direction with substantially constant groove width which is preferably matched to a projection width of at least one associated projection, and wherein n guide grooves are formed in the sleeve part with $n > 1$, such that the guide grooves, at their front end, cover a circumferential angular range of approximately 360%, the groove walls of adjacent guide grooves being directly adjacent to one another at their front end.

* * * * *